US012203207B2

(12) United States Patent
Seo et al.

(10) Patent No.: US 12,203,207 B2
(45) Date of Patent: Jan. 21, 2025

(54) CLOTHES CARE APPARATUS

(71) Applicant: Samsung Electronics Co., Ltd., Suwon-si (KR)

(72) Inventors: Dong-Pil Seo, Suwon-si (KR); Ki Sun Park, Suwon-si (KR); Jae Ryong Park, Suwon-si (KR); Hyeong Joon Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 995 days.

(21) Appl. No.: 17/250,706

(22) PCT Filed: Aug. 6, 2019

(86) PCT No.: PCT/KR2019/009829
§ 371 (c)(1),
(2) Date: Feb. 22, 2021

(87) PCT Pub. No.: WO2020/040453
PCT Pub. Date: Feb. 27, 2020

(65) Prior Publication Data

US 2021/0310179 A1 Oct. 7, 2021

(30) Foreign Application Priority Data

Aug. 20, 2018 (KR) ..... 10-2018-0097003

(51) Int. Cl.
*D06F 58/10* (2006.01)
*D06F 58/24* (2006.01)
*D06F 73/02* (2006.01)

(52) U.S. Cl.
CPC ..... *D06F 58/10* (2013.01); *D06F 58/24* (2013.01); *D06F 73/02* (2013.01)

(58) Field of Classification Search
CPC ..... F25D 21/14
See application file for complete search history.

(56) References Cited

U.S. PATENT DOCUMENTS 9,057,152 B2 6/2015 Park et al.
9,506,185 B2 11/2016 Choi et al.
10,526,746 B2 1/2020 Kitayama et al.

FOREIGN PATENT DOCUMENTS

EP 1148168 A2 * 10/2001 ..... D06F 58/10
EP 3124684 A1 2/2017
(Continued)

OTHER PUBLICATIONS

Notice of Preliminary Rejection dated May 31, 2023, in connection with Korean Application No. 10-2018-0097003, 17 pages.
(Continued)

*Primary Examiner* — Jason Lau

(57) ABSTRACT

Provided is a clothes care apparatus with a plate improved to prevent water leakage. The clothes care apparatus includes: a main body including a care room accommodating clothes; a base module provided inside the main body, and positioned below the care room; a base plate on which the base module mounted, the base plate including a guide portion guiding moisture inside the main body to prevent the moisture inside the main body from leaking out of the main body; and a bottom plate positioned below the base plate, and including a receiving portion collecting the moisture guided by the guide portion.

13 Claims, 8 Drawing Sheets

(56) References Cited

FOREIGN PATENT DOCUMENTS

| | | | | |
|---|---|---|---|---|
| JP | 2005188872 | A | * | 7/2005 |
| KR | 10-2009-0069755 | A | | 7/2009 |
| KR | 10-2009-0102399 | A | | 9/2009 |
| KR | 20100029368 | A | * | 3/2010 |
| KR | 10-2011-0067834 | A | | 6/2011 |
| KR | 10-2011-0125984 | A | | 11/2011 |
| KR | 10-2014-0108454 | A | | 9/2014 |
| KR | 10-2015-0137468 | A | | 12/2015 |
| KR | 10-2016-0136197 | A | | 11/2016 |
| KR | 10-2016-0149593 | A | | 12/2016 |

OTHER PUBLICATIONS

International Search Report and Written Opinion of the International Searching Authority in connection with International Application No. PCT/KR2019/009829 dated Nov. 27, 2019, 12 pages.

* cited by examiner

CLOTHES CARE APPARATUS

CROSS-REFERENCE TO RELATED APPLICATIONS

This application is a 371 National Stage of International Application No. PCT/KR2019/009829, filed Aug. 6, 2019, which claims priority to Korean Patent Application No. 10-2018-0097003 filed Aug. 20, 2018, the disclosures of which are herein incorporated by reference in their entirety.

BACKGROUND

1. Field

The disclosure relates to a clothes care apparatus with a plate improved to prevent water leakage.

2. Description of Related Art

A clothes care apparatus is equipment for clothes care, such as drying wet clothes, removing dust gathered on clothes or smell permeated in clothes, and smoothing out the wrinkles of clothes.

A clothes care apparatus includes a heat exchanger for supplying hot air to a care room in which clothes are accommodated to dry the clothes, and a steam generator configured to perform a refresh function, such as removing the wrinkles of clothes and the like, deodorization, removal of static electricity, etc.

The clothes care apparatus includes a main body forming the care room in which clothes are accommodated. A machine room in which the steam generator, the heat exchanger, etc. are installed is positioned below the care room. The machine room is separated from the care room.

The clothes care apparatus dries clothes accommodated in the care room through the heat exchanger included in the machine room, dehumidifies humid air resulting from drying the clothes through the heat exchanger, and then again supplies the dehumidified air to the care room.

A base module including the heat exchanger, the steam generator, etc. included in the machine room is coupled with a base plate for convenience of installation and assembling, and then coupled with a bottom plate forming a bottom of the main body by a sliding method.

In the base module including various hoses, the heat exchanger, etc., water leakage may occur due to dew formation caused by a temperature difference or incomplete assembling.

When a large amount of leaking water is generated in the base module, a consumer can recognize a defect of the product and take action quickly, but a small amount of leaking water generated in the base module may be left without being recognized by the consumer.

Moisture leaked out of the main body and left may corrode or contaminate a floor material on which the clothes care apparatus is installed. Accordingly, the clothes care apparatus needs to include a structure capable of preventing such water leakage.

SUMMARY

The present disclosure provides a clothes care apparatus improved to prevent a small amount of leaking water generated by dew formation caused by a temperature difference or incomplete assembling of hoses, etc. from leaking out of the clothes care apparatus.

The present disclosure provides a clothes care apparatus including a base plate and a bottom plate improved to prevent water leakage.

Additional aspects of the disclosure will be set forth in part in the description which follows and, in part, will be obvious from the description, or may be learned by practice of the disclosure.

In accordance with a concept of the disclosure, a clothes care apparatus includes: a main body including a care room accommodating clothes; a base module provided inside the main body, and positioned below the care room; a base plate on which the base module is mounted, the base plate including a guide portion guiding moisture inside the main body to prevent the moisture inside the main body from leaking out of the main body; and a bottom plate positioned below the base plate, and including a receiving portion collecting the moisture guided by the guide portion.

The bottom plate may further include a coupling portion with which the base plate is coupled, and the receiving portion may form a step with the coupling portion.

The receiving portion may include a groove formed downward from the coupling portion to collect moisture generated from the base module.

The base plate may further include an installation portion supporting the base module, and the guide portion may form a step with the installation portion.

The guide portion may include a groove formed downward from the installation portion to collect moisture generated from the base module.

The guide portion may be positioned in the base plate to correspond to a location at which the base module is mounted on the base plate.

The receiving portion may be positioned in the bottom plate to correspond to a location at which the guide portion is positioned in the base plate.

The receiving portion may be spaced from edges of the bottom plate.

The base plate may further include a guide hole guiding the moisture inside the main body from the guide portion to the receiving portion.

The guide hole may be formed around a center of the base plate.

A plurality of guide holes may be provided.

The guide portion may include a first guide portion forming a step downward from the installation portion, and a second guide portion forming a step downward from the first guide portion.

The guide hole may be formed in the second guide portion.

The base plate on which the base module is mounted may slide to be coupled with the bottom plate forming a bottom of the machine room positioned below the care room.

The base module may include a heat exchanger configured to heat-exchange air of the care room, and the clothes care apparatus may further include a drain container positioned inside the main body to collect condensed water generated from the heat exchanger.

In another aspect, according to a concept of the disclosure, a clothes care apparatus includes: a main body including a care room accommodating clothes; a machine room on which a base module including a heat exchanger configured to heat-exchange air of the care room is mounted; a drain container positioned adjacent to the machine room and collecting condensed water generated from the heat exchanger; a bottom plate forming a bottom of the machine room, and including a receiving portion configured to prevent moisture inside the machine room from leaking out of the machine room; a base plate coupled with a upper side of the bottom plate to support the base module, and including a guide hole guiding the moisture inside the machine room to the receiving portion.

The base plate may further include a guide portion which collects the moisture inside the machine room and in which the guide hole is formed.

The receiving portion or the guide portion may include a groove formed downward.

In another aspect, according to a concept of the disclosure, a clothes care apparatus includes: an external cabinet; an internal cabinet positioned inside the external cabinet, and accommodating clothes; a base module positioned below the internal cabinet; and a base plate positioned inside the external cabinet to support the base module, the base plate including a guide portion collecting and guiding moisture generated from the base module.

The clothes care apparatus may further include a bottom plate including a receiving portion collecting the moisture guided by the guide portion to prevent the moisture collected in the guide portion from leaking out of the external cabinet.

According to the disclosure, it may be possible to prevent a floor material on which the clothes care apparatus is installed from being corroded or contaminated due to a small amount of leaking water generated by dew formation caused by a temperature difference or incomplete assembling of hoses, etc.

According to the disclosure, by including the base plate and the bottom plate improved to prevent water leakage, a small amount of leaking water generated by dew formation caused by a temperature difference or incomplete assembling of hoses, etc. may be prevented from leaking out of the clothes care apparatus.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
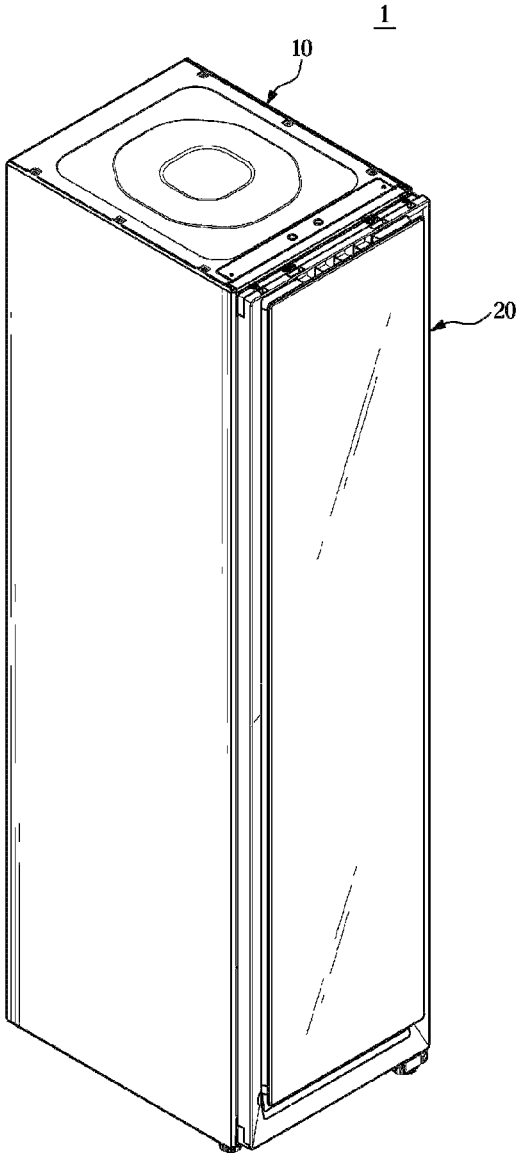
FIG. 1 is a perspective view of a clothes care apparatus according to an embodiment of the disclosure.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

The terms used in the present specification are merely used to describe embodiments, and are not intended to limit and/or restrict the disclosure. An expression used in the singular encompasses the expression of the plural, unless it has a clearly different meaning in the context.

In the present specification, it is to be understood that the terms such as "including" or "having," etc., are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

Also, it will be understood that, although the terms "first", "second", etc., may be used herein to describe various components, these components should not be limited by these terms. The above terms are used only to distinguish one component from another.

For example, a first component discussed below could be termed a second component, and similarly, a second component may be termed a first component without departing from the scope of right of the disclosure. As used herein, the term "and/or" includes any and all combinations of one or more of the associated listed items.

In the following description, the terms "front", "rear", "upper", and "lower" are defined based on the drawings, and the shapes and positions of the corresponding components are not limited by the terms.

Hereinafter, the embodiments of the disclosure will be described in detail with reference to the accompanying drawings.

Figure 2:
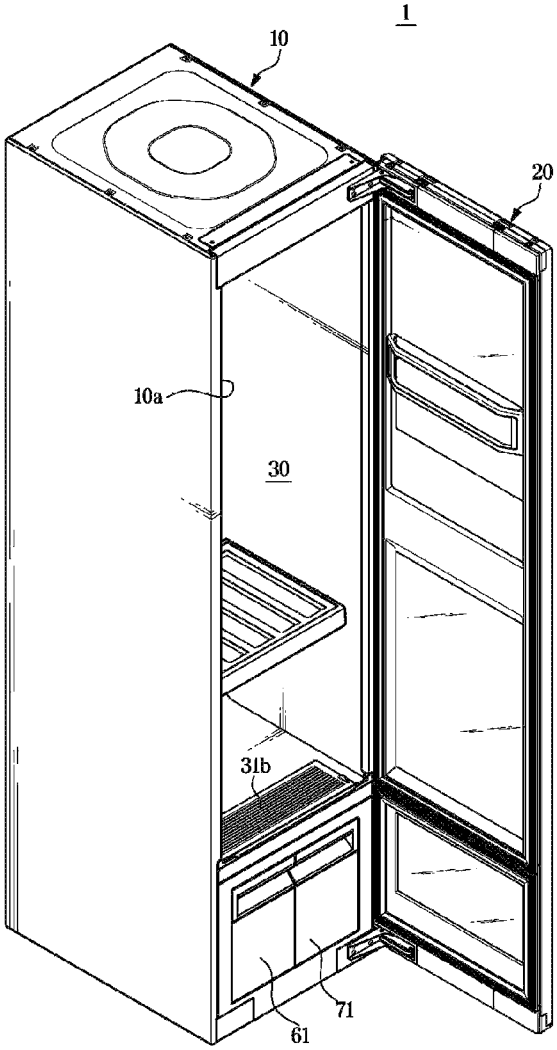
FIG. 2 illustrates a state in which a door of a clothes care apparatus according to an embodiment of the disclosure opens.

FIG. 1 is a perspective view of a clothes care apparatus according to an embodiment of the disclosure. FIG. 2 illustrates a state in which a door of a clothes care apparatus according to an embodiment of the disclosure opens.

As shown in FIGS. 1 and 2, a clothes care apparatus 1 may include a main body 10 forming an outer appearance, and a door 20 rotatably coupled with the main body 10.

The main body 10 may be substantially in a shape of a hexahedron of which one side opens. In a front side of the main body 10, an opening 10*a* may be formed. The door 20 may be rotatably coupled with the opening 10*a* to open or close a care room 30.

Although not shown in the drawings, the door 20 may be installed in the opening 10*a* through a hinge, a link, etc.

The main body 10 may include the care room 30 for accommodating and caring clothes. A front side of the care room 30 may open. The care room 30 may also be opened or closed by the door 20 that opens or closes the opening 10*a*.

Figure 3:
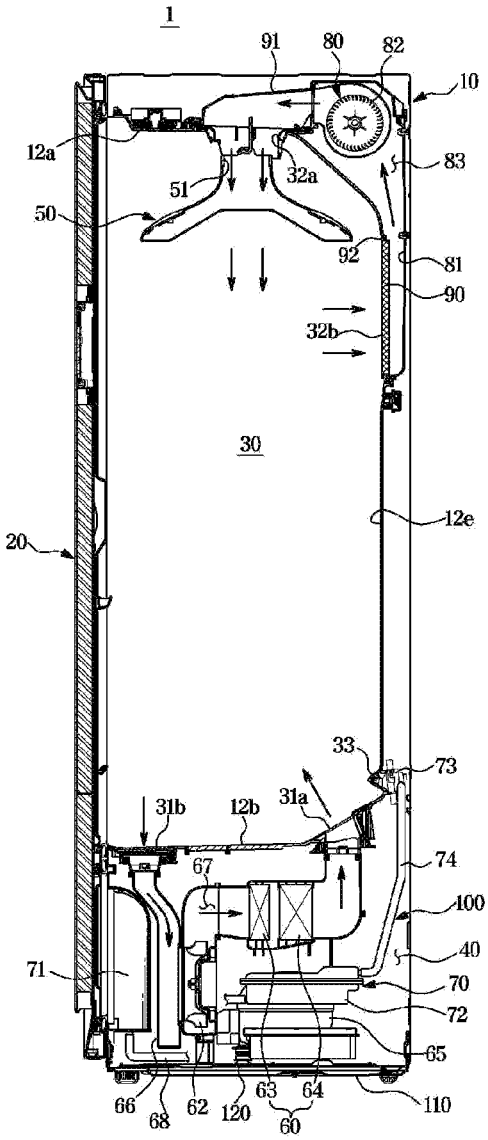
FIG. 3 is a side cross-sectional view of a clothes care apparatus according to an embodiment of the disclosure.
Figure 4:
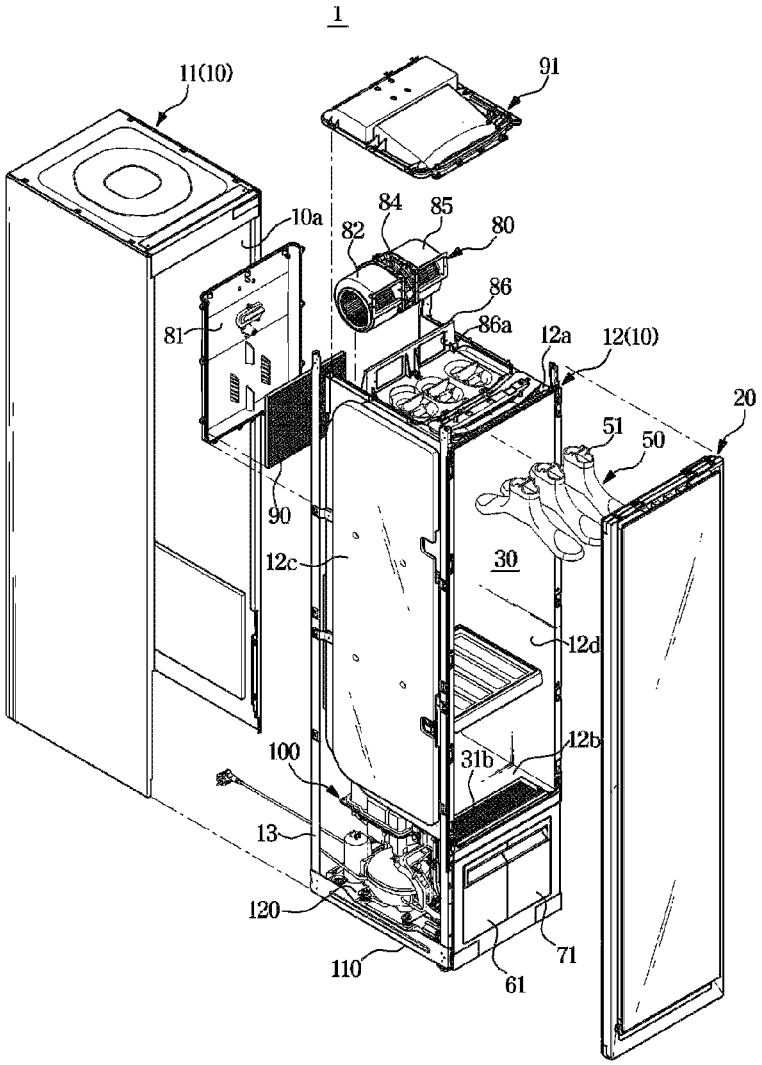
FIG. 4 is an exploded perspective view of a clothes care apparatus according to an embodiment of the disclosure.

FIG. 3 is a side cross-sectional view of a clothes care apparatus according to an embodiment of the disclosure. FIG. 4 is an exploded perspective view of a clothes care apparatus according to an embodiment of the disclosure.

As shown in FIGS. 3 and 4, the main body 10 may include an external cabinet 11, and an internal cabinet 12 positioned inside the external cabinet 11. The main body 10 may include a support member 50 provided inside the care room 30 to hang clothes.

The main body 10 may include a machine room 40 where a base module 100 such as a heat exchanger 60, etc. for dehumidifying or heating inside air of the care room 30 is accommodated.

The care room 30 may form a space where clothes are accommodated. The care room 30 may be defined by a top plate 12*a*, a bottom plate 12*b*, a left plate 12*c*, a right plate 12*d*, and a rear plate 12*e* of the internal cabinet 12.

The internal cabinet 12 may include a frame 13 (see FIG. 4) supporting the top plate 12*a*, the bottom plate 12*b*, the left plate 12*c*, the right plate 12*d*, and the rear plate 12*e*.

The frame 13 may form the care room 30 and the machine room 40 positioned below the care room 30, although not limited thereto.

The support member 50 may be installed in the top plate 12*a* of the care room 30. The support member 50 may be separable from the care room 30. At least one support member 50 may be provided. The support member 50 may be formed in a shape of a hanger to hang clothes.

The support member 50 may make air flow to the inside. Dust or foreign materials attached to clothes may be removed by air supplied to the inside of the support member 50.

In the support member 50, an air hole 51 may be formed to supply air to the clothes. The air hole 51 of the clothes care apparatus 1 according to an embodiment of the disclosure may be formed at a top end of the support member 50, so that air may be supplied to the inside and outside of clothes through the air hole 51, although not limited thereto.

However, the air hole 51 may be formed with various sizes at various locations to spray supplied air to clothes over a wide area.

The care room 30 may include a first inlet 31*a*, a second inlet 32*a*, a first outlet 31*b*, a second outlet 32*b*, and a steam inlet 33.

The first inlet 31*a* and the first outlet 31*b* may be formed in the bottom plate 12*b* of the care room 30. The first inlet 31*a* may be positioned in a rear area of the bottom plate 12*b* of the care room 30. The first outlet 31*b* may be positioned in a front area of the bottom plate 12*b* of the care room 30. The first inlet 31*a* may be adjacent to the first outlet 31*b*.

The steam inlet 33 may be formed in a lower area of the rear plate 12*e* of the care room 30. The steam inlet 33 may be positioned above the first inlet 31*a*.

The second inlet 32*a* may be formed above the top plate 12*a* of the care room 30. The second outlet 32*b* may be formed in a center of the rear plate 12*e* of the care room 30. The second inlet 32*a* may be adjacent to the second outlet 32*b*.

The second inlet 32*a* of the care room 30 may be connected to the support member 50. Air entered through the second inlet 32*a* may be transferred to the support member 50 through the air hole 51 and transferred to clothes hanging on the support member 50.

In a lower portion of the main body 10, a drain container 61 and a water supply container 71 that are separable from the main body 10 may be installed. The drain container 61 and the water supply container 71 may be positioned below the care room 30.

The drain container 61 may be configured to easily treat condensed water generated by the heat exchanger 60. The water supply container 71 may store water required by a steam generator 70 for generating steam.

Water stored in the water supply container 71 may be supplied to the steam generator 70 and used to generate steam. The water supply container 71 may be separable from the main body 10 to easily add water.

The drain container 61 and the water supply container 71 may be positioned in a front side of the machine room 40. The machine room 40 may be positioned in the lower portion of the main body 10. The machine room 40 may be positioned below the care room 30.

The machine room 40 in which the base module 100 is installed may be positioned in a lower portion of the internal cabinet 12. The machine room 40 may include a bottom plate 110 forming a bottom of the machine room 40.

The base plate 120 supporting the base module 100 may be provided inside the external cabinet 11 and coupled with a upper side of the bottom plate 110.

The base module 100 may include the heat exchanger 60, the steam generator 70, or various hoses 68. The various hoses 68 may be used in the heat exchanger 60 or the steam generator 70.

The heat exchanger 60 may dehumidify and heat inside air of the care room 30 as necessary. The base module 100 may include the heat exchanger 60, a first fan 62, and the steam generator 70.

The heat exchanger 60 may supply hot air to the inside of the care room 30. The heat exchanger 60 may include an evaporator 63, a condenser 64, and a compressor 65, through which a refrigerant circulates, to dehumidify and heat air.

While a refrigerant evaporates in the evaporator 63 of the heat exchanger 60, the refrigerant may absorb latent heat from surrounding air to condense moisture in the air and remove the moisture.

In the case in which the refrigerant passes through the compressor 65 and then is condensed in the condenser 64, the refrigerator may emit the latent heat toward surrounding air to thereby heat the surrounding air.

The evaporator 63 and the condenser 64 may perform a heat-exchange function so that air entered the machine room 40 by the first fan 62 passes the evaporator 63 and the condenser 64 sequentially to be dehumidified and heated.

The heat exchanger 60 installed in the machine room 40 may include a first duct 66 that connects the evaporator 63, the condenser 64 and the first fan 62, and the first duct 66 may be connected to the care room 30 to form a first flow path 67 for circulation between the care room 30 and the first duct 66.

The first duct 66 may be connected to the first inlet 31*a* and the first outlet 31*b* of the care room 30. One end of the first duct 66 may be connected to the first inlet 31*a*, and the other end of the first duct 66 may be connected to the first outlet 31*b*.

Air of the care room 30 may enter the first duct 66 through the first outlet 31*b*, and the air may be dehumidified and then again enter the care room 30 through the first inlet 31*a*.

In the clothes care apparatus 1 according to an embodiment of the disclosure, an example in which the first inlet 31*a* is positioned in a rear area of the care room 30, and the first outlet 31*b* is positioned in a front area of the care room 30 is shown. However, a concept of the disclosure is not limited to this.

For example, the first inlet 31*a* and the first outlet 31*b* may be positioned at different locations as necessary.

The first duct 66 may dehumidify air entered through the first outlet 31*b* and discharge the dehumidified air to the first inlet 31*a*. The first fan 62 may be positioned on the first duct 66 to inhale air of the care room 30 to inside of the first duct 66.

The base module 100 may include the steam generator 70 for receiving water from the water supply container 71 and generating steam. The steam generator 70 may be positioned inside the machine room 40.

The steam generator 70 may include a steam generating portion 72 connected to the water supply container 71 to receive water and generate steam, and a steam supply pipe 74 for guiding the generated steam to a steam spray 73.

The steam spray 73 may be positioned at the lower area of the rear plate 12*e* of the care room 30. A heater (not shown) may be installed inside the steam generating portion 72 to heat water.

The care room 30 may include a blower 80 to make inside air of the care room 30 flow. The blower 80 may include a second duct 81, and a second fan 82 may be installed inside the second duct 81.

The second duct 81 may communicate with the care room 30 to form a second flow path 83 for circulation between the care room 30 and the second duct 81. The second fan 82 may be positioned on the second flow path 83.

The second duct 81 may be formed behind the second outlet 32*b* of the care room 30. The second duct 81 may be provided in an upper area of the rear plate 12*e* of the care room 30, and include a filter 90 therein.

The filter 90 may be a High Efficiency Particulate Air (HEPA) filter, although not limited thereto.

The second duct 81 may be coupled with a top cover 91 positioned above the care room 30. The blower 80 may be positioned in an upper and rear area of the care room 30, and include a motor 84 for generating a rotation force, and at least one second fan 82 that rotates by the motor 84.

A shaft of the motor 84 may protrude at its both sides, and the second fan 82 may be coupled with each of both ends of the shaft. Through such a structure, the motor 84 may rotate a pair of second fans 82.

Each of the second fans 82 may be a centrifugal fan for inhaling air in an extension direction of the shaft and discharging the air outward in a radial direction, although not limited thereto.

The second fan 82 may be accommodated in a fan case 85. The fan case 85 may be coupled with a duct bracket 86 provided on the top plate 12*a* of the care room 30.

In the duct bracket 86, at least one duct hole 86*a* may be formed, and the second fan 82 may be coupled with the at least one duct hole 86*a* to move air of the second duct 81 to the second inlet 32*a*.

The second duct 81 may be connected to the second inlet 32*a* and the second outlet 32*b* of the care room 30. One end of the second duct 81 may be connected to the second inlet 32*a*, and the other end of the second duct 81 may be connected to the second outlet 32*b* of the care room 30.

The second inlet 32*a* may be connected to the support member 50 to transfer air of the second duct 81 to the support member 50.

The second fan 82 installed inside the second duct 81 may inhale inside air of the care room 30 through the second outlet 32*b* and discharge the inhaled air through the second inlet 32*a*.

In the rear plate 12*e* of the care room 30, a filter installing portion 92 may be provided to install the filter 90. The second outlet 32*b* may be formed at a location corresponding to the filter installing portion 92.

Inside air of the care room 30 may be, when entering the second duct 81, filtered by the filter 90 installed at the second outlet 32*b*. The filter 90 may remove dust and smell from air that enters the second duct 81.

The air filtered by the filter 90 may be discharged to the support member 50 through the blower 80. The filter 90 may include a dust collecting filter (not shown) for removing dust, or a deodorizing device.

A user may operate the care room 30 for caring clothes after hanging the clothes on the support member 50 and closing the door 20. In the care room 30, air may circulate along the first flow path 67 and the second flow path 83.

Figure 5:
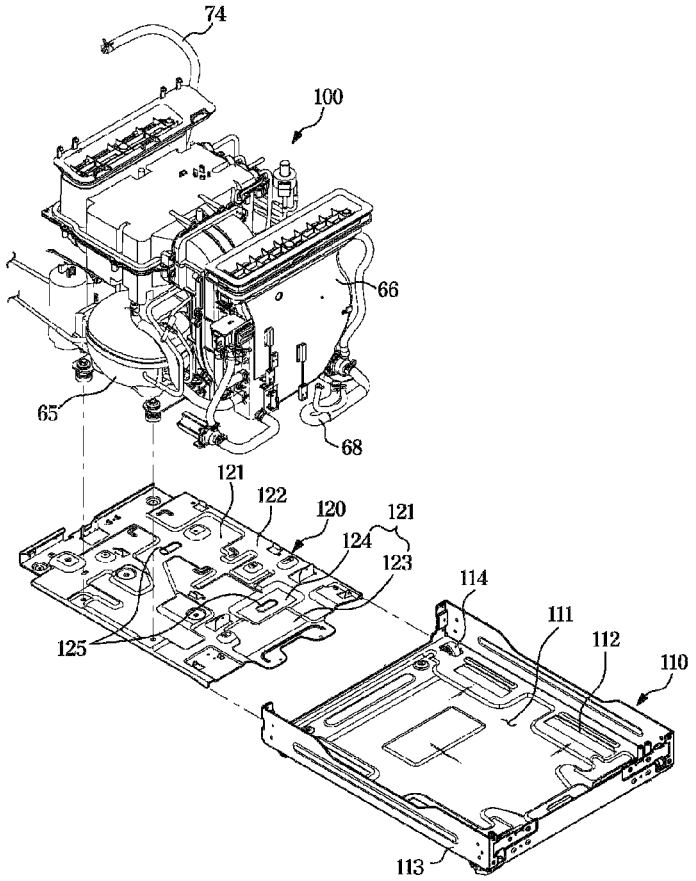
FIG. 5 illustrates a base module and a base plate that are detachably coupled with a bottom plate, in a clothes care apparatus according to an embodiment of the disclosure.
Figure 6:
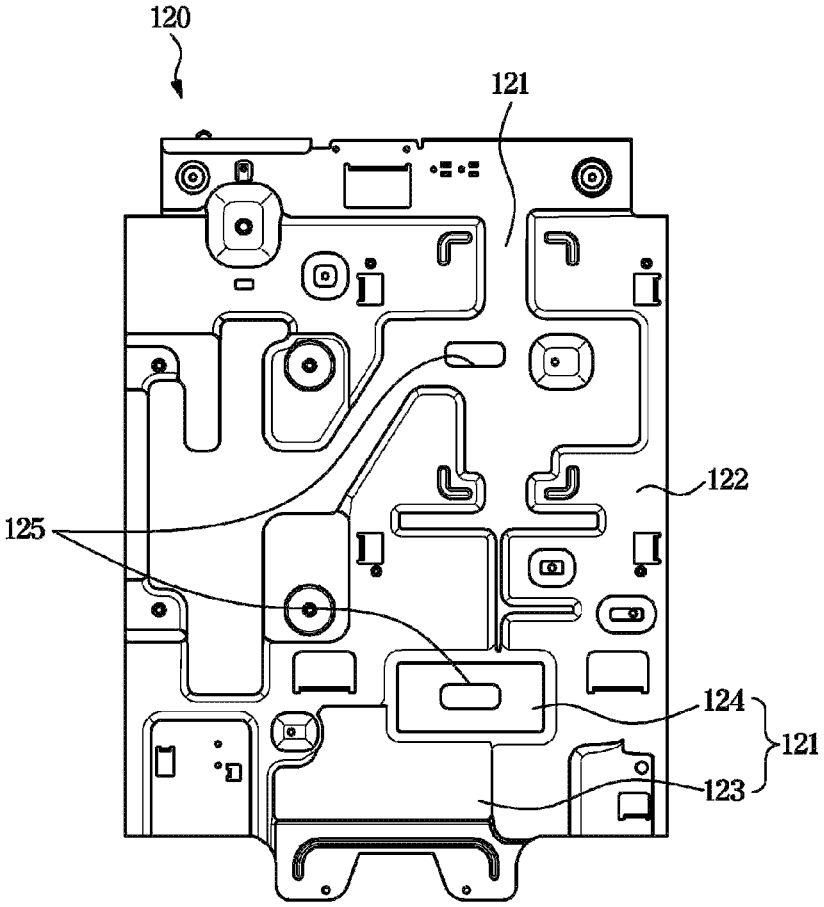
FIG. 6 illustrates a base plate in a clothes care apparatus according to an embodiment of the disclosure.
Figure 7:
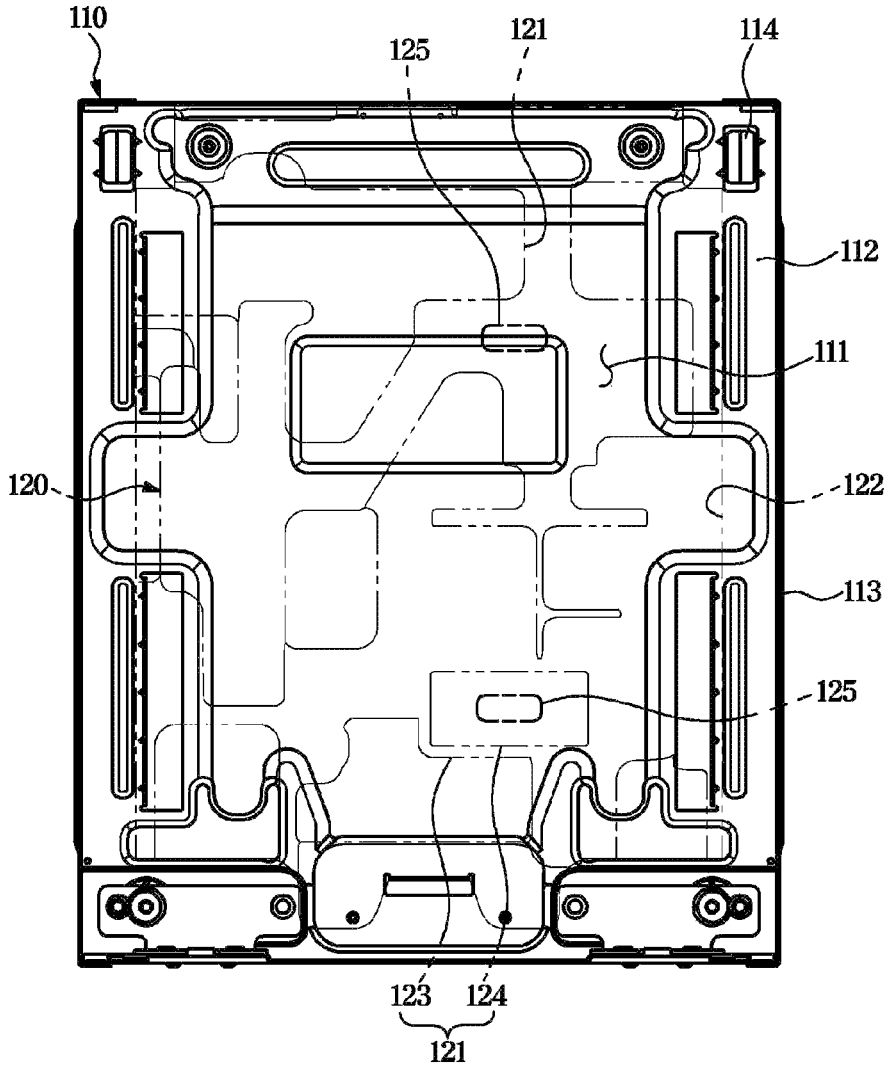
FIG. 7 illustrates a bottom plate positioned below a base plate, in a clothes care apparatus according to an embodiment of the disclosure.

FIG. 5 illustrates a base plate and a base module detachably coupled with a bottom plate, in a clothes care apparatus according to an embodiment of the disclosure. FIG. 6 illustrates a base plate in a clothes care apparatus according to an embodiment of the disclosure. FIG. 7 illustrates a bottom plate positioned below a base plate, in a clothes care apparatus according to an embodiment of the disclosure.

As shown in FIGS. 5 to 7, the base module 100 including the heat exchanger 60 (see FIG. 3), the steam generator 70 (see FIG. 3), etc. included in the machine room 40 (see FIG. 3) may be coupled with the base plate 120 and then coupled with the bottom plate 110 forming the bottom of the machine room 40 together with the base plate 120, for convenience of installation and assembling.

The base module 100 coupled with the base plate 120 may slide to be coupled with the bottom plate 110, although not limited thereto.

The base module 100 may be positioned on the base plate 120, and the base plate 120 may be positioned on the bottom plate 110. The base plate 120 and the bottom plate 110 may include different materials, although not limited thereto.

The bottom plate 110 may include a wheel 114 for moving the clothes care apparatus 1 (see FIG. 1), and a side wall 113 for coupling with the internal cabinet 12 (see FIG. 4).

A plurality of wheels 114 may be provided. The side wall 113 may protrude upward from an edge of the bottom plate 110. The side wall 113 may be positioned between the internal cabinet 12 and the external cabinet 11 (see FIG. 4).

The side wall 113 may be coupled with the frame 13 of the internal cabinet 12. The side wall 113 may be coupled with an outer side of the frame 13. The bottom plate 110 coupled with the internal cabinet 12 may be coupled with the external cabinet 11. The side wall 113 may be positioned between the external cabinet 11 and the frame 13 of the internal frame 12, although not limited thereto.

The bottom plate 110 may be substantially in a shape of a rectangle, and the side wall 113 may be positioned at three edges of the bottom plate 110 except for one edge of the bottom plate 110.

The base plate 120 on which the base module 100 is mounted may be coupled with the bottom plate 110 through the one edge of the bottom plate 110 at which the side wall 113 is not provided, although not limited thereto.

The side plate 113 may cover some portions of the base module 100 and the base plate 120 coupled with the bottom plate 110.

There may be a case in which moisture inside the main body 10 (see FIG. 1) or the machine room 40 leaks out of the main body 10 or the machine room 40, while the clothes care apparatus 1 according to an embodiment of the disclosure is used.

In the case in which moisture inside the main body 10 or the machine room 40 leaks out of the main body 10 or the machine room 40, the moisture may corrode or contaminate a floor material on which the clothes care apparatus 1 is installed.

For example, in the base module 100 including the various hoses 68, the steam supply pipe 74, the heat exchanger 60 (see FIG. 3), etc., dew condensation caused by a temperature difference between inside and outside, or water leakage caused by incomplete assembling between components may occur.

The bottom plate 110 of the clothes care apparatus 1 according to an embodiment of the disclosure may include a receiving portion 111 for preventing moisture inside the main body 10 or the machine room 40 or moisture generated from the base module 100 from leaking out of the main body 10.

The bottom plate 110 may include a coupling portion 112 by which the base plate 120 is coupled on the bottom plate 110, and the receiving portion 111 may form a step with the coupling portion 112.

A height of the receiving portion 11 from a floor on which the clothes care apparatus 1 is installed may be lower than that of the coupling portion 112 from the floor on which the clothes care apparatus 1 is installed.

The receiving portion 111 may include a groove formed downward from the coupling portion 112 to collect moisture inside the main body 10, although not limited thereto.

Accordingly, the clothes care apparatus 1 according to an embodiment of the disclosure may include the receiving portion 111 forming a step with the coupling portion 112 so that moisture inside the main body 10 may be collected in the receiving portion 111 without leaking out of the main body 10.

Because the receiving portion 111 and the coupling portion 112 form a step with respect to each other, the bottom plate 110 may form a bead to reinforce stiffness.

The clothes care apparatus 1 according to an embodiment of the disclosure may include the base plate 120 which is positioned on the bottom plate 110 and on which the base module 110 is mounted.

The base plate 120 may include a guide portion 121 for receiving moisture inside the main body 10 or the machine room 40 or moisture generated from the base module 100.

The base plate 120 may include an installation portion 122 supporting the base module 100, and the guide portion 121 may form a step with the installation portion 122.

A height of the guide portion 121 from the coupling portion 112 of the bottom plate 110 may be lower than that of the installation portion 122 from the coupling portion 112 of the bottom plate 110.

The guide portion 121 may include a groove formed downward from the installation portion 122 to collect moisture inside the main body 10, although not limited thereto.

Accordingly, the clothes care apparatus 1 according to an embodiment of the disclosure may include the guide portion 121 forming a step with the installation portion 122 so that moisture inside the main body 10 may be collected in the guide portion 121 without leaking out of the main body 10.

Because the guide portion 121 and the installation portion 122 form a step with respect to each other, the base plate 120 may form a bead to reinforce stiffness.

The guide portion 121 may include a first guide portion 123 forming a step downward from the installation portion 122, and a second guide portion 124 forming a step downward from the first guide portion 123.

A height of the first guide portion 123 from the coupling portion 112 of the bottom plate 110 may be higher than that of the second guide portion 124 from the coupling portion 112 of the bottom plate 110.

In the drawings, a case in which the guide portion 121 includes the first guide portion 123 and the second guide portion 124 forming a step with the first guide portion 123 is shown. However, the guide portion 121 is not limited to this.

The guide portion 121 may include a plurality of guide portions 121 having steps with respect to each other, in addition to the first guide portion 123 and the second guide portion 124.

The guide portion 121 may guide moisture collected therein to the receiving portion 111 of the bottom plate 110. The guide portion 121 may collect moisture inside the main body 10, while guiding the moisture inside the main body 10 to the receiving portion 111 of the bottom plate 110.

The base plate 120 may include a guide hole 125 for guiding moisture inside the main body 10 from the guide portion 121 to the receiving portion 111. The guide hole 125 may enable the guide portion 121 to communicate with the receiving portion 111.

Moisture collected in the guide portion 121 may be guided to the receiving portion 111 of the bottom plate 110 positioned below the base plate 120 through the guide hole 125, by gravity.

The guide portion 121 may be inclined to easily guide the moisture collected in the guide portion 121 to the receiving portion 111 through the guide hole 125. The guide portion 121 may be inclined toward the guide hole 125.

A height of the guide hole 125 from the coupling portion 112 of the bottom plate 110 may be lower than that of the guide portion 121 from the coupling portion 112 of the bottom plate 110, although not limited thereto.

Because moisture inside the main body 10 is generated mainly from the base module 100, the guide portion 121 according to an embodiment of the disclosure may be positioned in the base plate 120 to correspond to a location at which the base module 100 is mounted on the base plate 120.

Accordingly, moisture generated from the base module 100 may be easily collected in the guide portion 121 positioned at a location corresponding to the location at which the base module 100 is mounted on the base plate 120, by gravity.

Moisture on the base plate 120 may be collected in the guide portion 121, not the installation portion 122.

The receiving portion 111 may be positioned in the bottom plate 110 to correspond to the location at which the guide portion 121 is positioned in the base plate.

Accordingly, moisture guided from the base plate 120 may be easily collected in the receiving portion 111 positioned at a location corresponding to the location at which the guide portion 121 is positioned in the base plate 120, by gravity.

Moisture on the bottom plate 120 may be collected in the receiving portion 111, not the coupling portion 112.

The receiving portion 111 may be spaced from the edges of the bottom plate 110. The receiving portion 111 may be positioned around a center of the bottom plate 110, although not limited thereto.

The receiving portion 111 according to an embodiment of the disclosure may be positioned in the bottom plate 110 to correspond to the location at which the guide portion 121 is positioned in the base plate 120, so that moisture collected in and guided by the guide portion 121 is collected in the receiving portion 111 through the guide hole 125 by gravity.

The guide hole 125 may enable the guide portion 121 of the base plate 120 to communicate with the receiving portion 111 of the bottom plate 110. The guide hole 125 may be positioned around the center of the base plate 120.

A plurality of guide holes 125 may be provided. The guide holes 125 may be formed in the second guide portion 124.

In the drawing, two guide holes 125 are formed in the second guide portion 12, although not limited thereto.

However, the guide holes 125 may be formed at various locations without limitation in number, as long as the guide holes 125 enable the guide portion 121 to communicate with the receiving portion 111 to guide moisture collected in the guide portion 121 to the receiving portion 111.

The clothes care apparatus 1 according to an embodiment of the disclosure may include only the base plate 120 including the guide portion 121, as a structure for collecting moisture inside the main body 10, separately from the bottom plate 110.

That is, the bottom plate 110 may form an outer appearance of the main body 10, and moisture inside the main body 10 may be collected in the guide portion 121 provided in the base plate 120.

Figure 8:
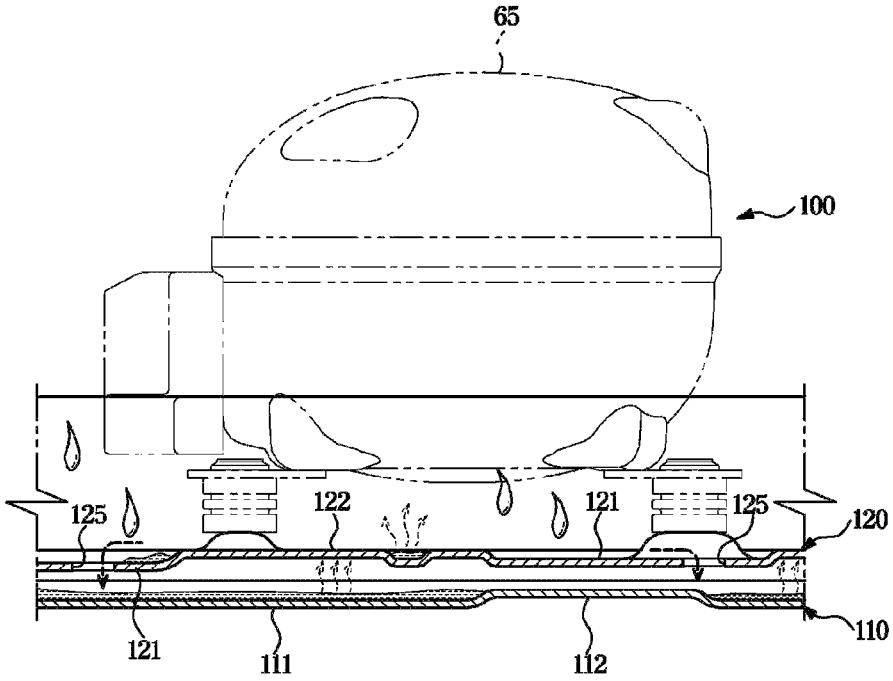
FIG. 8 illustrates a state in which water leakage is prevented by a base plate and a bottom plate, in a clothes care apparatus according to an embodiment of the disclosure.

FIG. 8 illustrates a state in which water leakage is prevented by a base plate and a bottom plate, in a clothes care apparatus according to an embodiment of the disclosure.

As shown in FIG. 8, in the case in which a large amount of moisture inside the main body 10 (see FIG. 3) or the machine room 40 (see FIG. 3), or a large amount of moisture generated from the base module 100 leaks out of the main body 10, a consumer may recognize a defect of the product and take action quickly.

Meanwhile, in the case in which a small amount of moisture inside the main body 10 leaks out of the main body 10, the consumer may leave the moisture because he/she could not recognize the moisture. Moisture leaked out of the main body 10 and left may corrode or contaminate a floor material on which the clothes care apparatus 1 (see FIG. 1) is installed.

The clothes care apparatus 1 according to an embodiment of the disclosure may prevent a small amount of moisture inside the main body 10 from leaking out of the main body 10 and collect the small amount of moisture inside the main body 10 so that the moisture evaporates naturally, although a consumer does not take action.

The guide portion 121 of the base plate 120 may be configured such that moisture collected in the guide portion 121 evaporates naturally without leaking out of the main body 10.

The receiving portion 111 of the bottom plate 110 may be configured such that moisture collected in the receiving portion 111 evaporates naturally without leaking out of the receiving portion 111.

Hereinafter, an operation in which the clothes care apparatus 1 according to an embodiment of the disclosure prevents water leakage will be described in detail with reference to FIG. 8.

While a user uses the clothes care apparatus 1, moisture may be formed inside the main body 10 or the machine room 40.

Particularly, in the base module 100 including the various hoses 68 (see FIG. 3), the heat exchanger 60 (see FIG. 3), etc., dew condensation caused by a temperature difference between inside and outside, or water leakage caused by incomplete assembling between components may occur.

A small amount of moisture generated in the inside of the main body 10, such as the base module 100, etc., may be guided to the base plate 120 or the bottom plate 110, positioned in the lower portion of the main body 10, by gravity.

The small amount of moisture generated in the inside of the main body 10, such as the base module 100, etc., may first be collected in the guide portion 121 of the base plate 120, by gravity.

A part of the small amount of moisture collected in the guide portion 121 may evaporate naturally over time.

The other part of the small amount of moisture collected in the guide portion 121 may be guided by the guide portion 121 to the receiving portion 111 of the bottom plate 110 positioned below the base plate 120, through the guide hole 125 formed in the guide portion 121, and collected in the receiving portion 111.

The small amount of moisture collected in the receiving portion 111 may evaporate naturally over time.

An area of the receiving portion 111 may be relatively greater than that of the guide portion 121, and accordingly, evaporation of moisture collected in the receiving portion 111 may occur better than evaporation of moisture collected in the guide portion 121, although not limited thereto.

Accordingly, the clothes care apparatus 1 according to an embodiment of the disclosure may include the guide portion 121 or the receiving portion 111 configured as a stepped bead to reinforce stiffness of the base plate 120 and the bottom plate 110, without including a separate receiving space, thereby collecting a small amount of moisture inside the main body 10.

Also, the clothes care apparatus 1 according to an embodiment of the disclosure may cause moisture collected in the guide portion 121 or the receiving portion 111 to evaporate naturally over time, without including a separate heater for evaporating a small amount of moisture collected in the guide portion 121 and the receiving portion 111.

So far, although the technical concept of the disclosure has been described based on specific embodiments, the scope of rights of the disclosure is not limited to these embodiments.

It should be interpreted that various embodiments modified or changed by a person skilled in the art within a scope not deviating from the gist of the disclosure as the technical concept of the disclosure, which is defined in the claims, also belong to the scope of rights of the disclosure.

The invention claimed is:

1. A clothes care apparatus comprising:

a main body including a care room accommodating clothes;

a base module provided inside the main body, and positioned below the care room;

a base plate on which the base module is mounted, the base plate including a guide portion guiding moisture inside the main body to prevent the moisture inside the main body from leaking out of the main body; and a bottom plate positioned below the base plate, including a receiving portion collecting the moisture guided by the guide portion, and a coupling portion with which the base plate is coupled, and the receiving portion forms a step with the coupling portion, and wherein the receiving portion comprises a groove formed downward from the coupling portion to collect moisture generated from the base module.

2. The clothes care apparatus according to claim 1, wherein the base plate further comprises an installation portion supporting the base module, and the guide portion forms a step with the installation portion.

3. The clothes care apparatus according to claim 2, wherein the guide portion comprises a groove formed downward from the installation portion to collect moisture generated from the base module.

4. The clothes care apparatus according to claim 1, wherein the guide portion is positioned in the base plate to correspond to a location at which the base module is mounted on the base plate.

5. The clothes care apparatus according to claim 1, wherein the receiving portion is positioned in the bottom plate to correspond to a location at which the guide portion is positioned in the base plate.

6. The clothes care apparatus according to claim 1, wherein the receiving portion is spaced from edges of the bottom plate.

7. The clothes care apparatus according to claim 2, wherein the base plate further comprises a guide hole guiding the moisture inside the main body from the guide portion to the receiving portion.

8. The clothes care apparatus according to claim 7, wherein the guide hole is formed around a center of the base plate.

9. The clothes care apparatus according to claim 7, wherein a plurality of guide holes are provided.

10. The clothes care apparatus according to claim 7, wherein the guide portion comprises a first guide portion forming a step downward from the installation portion, and a second guide portion forming a step downward from the first guide portion.

11. The clothes care apparatus according to claim 10, wherein the guide hole is formed in the second guide portion.

12. The clothes care apparatus according to claim 1, wherein the base plate on which the base module is mounted slides to be coupled with the bottom plate forming a bottom of a machine room positioned below the care room.

13. The clothes care apparatus according to claim 1, wherein the base module comprises a heat exchanger configured to heat-exchange air of the care room, the clothes care apparatus further comprising a drain container positioned inside the main body to collect condensed water generated from the heat exchanger.

* * * * *